US005482192A

United States Patent [19]

Sato et al.

[11] Patent Number: 5,482,192

[45] Date of Patent: Jan. 9, 1996

[54] PLATE BRICK CARTRIDGE FOR A SLIDE GATE VALVE, AND SLIDE GATE VALVE OF USING THE CARTRIDGE

[75] Inventors: Mitsukuni Sato, Okayama; Yosuke Kobayashi, Bizen; Masahiko Nose; Kenji Yamamoto, both of Okayama, all of Japan

[73] Assignee: Shinagawa Refractories Co., Ltd., Tokyo, Japan

[21] Appl. No.: 119,247

[22] PCT Filed: Mar. 23, 1992

[86] PCT No.: PCT/JP92/00351

§ 371 Date: Sep. 27, 1993

§ 102(e) Date: Sep. 27, 1993

[87] PCT Pub. No.: WO92/17299

PCT Pub. Date: Oct. 15, 1992

[30] Foreign Application Priority Data

Mar. 29, 1991 [JP] Japan ..... 3-066645

[51] Int. Cl.[6] ..... B22D 41/24

[52] U.S. Cl. ..... 222/600; 266/236

[58] Field of Search ..... 266/236; 222/600, 222/590, 603, 597

[56] References Cited

U.S. PATENT DOCUMENTS

| | | | |
|---|---|---|---|
| 3,554,520 | 1/1971 | Grosko | 222/600 |
| 3,937,372 | 2/1976 | Bode, Jr. | 222/600 |
| 4,415,103 | 11/1983 | Shapland et al. | 222/600 |
| 4,728,013 | 3/1988 | Winkelmann et al. | 222/600 |

FOREIGN PATENT DOCUMENTS

| | | |
|---|---|---|
| 53-102836 | 9/1978 | Japan . |
| 57-141860 | 9/1982 | Japan . |
| 58-93355 | 6/1983 | Japan . |
| 61-71171 | 4/1986 | Japan . |
| 2-41768 | 2/1990 | Japan . |

*Primary Examiner*—Scott Kastler

*Attorney, Agent, or Firm*—Larson and Taylor

[57] ABSTRACT

A plate brick assembly cartridge for a slide gate valve, in which metallic or ceramic holders are mounted to the outer peripheries of the sides of respective plates for the slide gate valve, and which is provided with an assembling mechanism for mutually engaging said holders, characterized in that both the faces of the holder for a slide plate are set slightly back from the sliding surface of said slide plate. The invention has any of the following constitutions. Voids for sensors for cold and/or temperature are provided in the holders, said voids communicating with one another. The sliding surfaces of the holders are provided with a ceramic coating. The plate brick for the slide gate valve is split. The contact faces of the holders with the plate bricks are made at angles of inclination. The surface pressure loading mechanism is of sliding, and opening and closing type, and provided with cylinders for surface pressure loading. All the above mechanisms are remote controlled. The slide gate valve has a submerged nozzle mounting mechanism. And a heat-resistant ceramic plate is involved wholly or partially between the bottom surface of the molten metal vessel and the slide gate valve.

6 Claims, 6 Drawing Sheets

PLATE BRICK CARTRIDGE FOR A SLIDE GATE VALVE, AND SLIDE GATE VALVE OF USING THE CARTRIDGE

FIELD OF THE INVENTION

This invention relates to a slide gate valve, and particularly to a plate brick cartridge for a slide gate valve, and a slide gate valve mounted with said cartridge.

BACKGROUND OF THE INVENTION

A known slide gate valve (hereinafter referred to as "SV" equipment) consists of a plurality of plate bricks, a housing arranged at the bottom surface of a vessel for molten metal, said housing storing said plate bricks, a surface pressure load mechanism for supporting suitable surface pressure between the contact surfaces of said plate bricks, and a slide plate driving mechanism.

A group of plate bricks are replaced by new ones when they have reached their life end. At that time, the replacement working is carried out in such a manner that the SV equipment is opened under on-line system, the plate bricks are removed one by one whereafter new plate bricks are set one by one, and the surface pressure is loaded by a surface pressure load mechanism thereby to complete the replacement. Another method for the replacement is such that the SV equipment is removed and a new SV equipment incorporated with new plate bricks is substituted therefor. In such method, the replacement working is carried out by an exlusive use machine, and the removed SV equipment is sent to the maintenance section (off-line) for repairing.

Said plate bricks are in one body, the periphery of a refractory provided at their center with a molten steel flow opening, is clamped by an iron band or wire, and the plate bricks are delivered in a single unit to customers. Further, to avoid leakage of molten steel and involvement of external air into the molten steel, the plate bricks conventionally are made large-sized.

Thus, the known plate bricks have the following demerits.

(1) Since the plate brick replacement working effected under on-line system after casting is carried out 20–30 minutes after casting, the temperature of the SV equipment and the refractory remains considerably high, and since it takes about 15 minutes for such working the working is a heavy hot working. Further, being a heavy hot working, it is likely that the working itself becomes moderate thereby causing troubles such as molten steel leakage due to erroneous setting of the bricks. Additionally, setting of the refractory bricks one by one makes mechanization difficult.

(2) Even in the case of replacing the refractory bricks in maintenance section (off-line) the bricks need to be replaced before the temperature of the SV equipment and the refractory is lowered to room temperature. Even in this stage the operation condition is still under a heavy hot working. Even in the case of replacing the refractory bricks after the temperature has lowered to room temperature, the weight of a single refractory is 5–25 kg, and therefore the heavy hot working still remains.

Referring to the working environment, since the slide gate valve is cleaned after the removal of the refractories after use, air blows or the like create a powdery dust atmosphere. In such case, a merit is just for mechanization of hot working, and not only a great amount of cost incurs for mechanization but also the refractory replacement working must be carried out by a worker so that man power cannot be saved.

(3) Plate bricks are constituted mostly by refractory, it is difficult to process refractory, great cracks are likely to generate in the processed portions, and therefore it is scarcely possible to mount a temperature sensor.

(4) Since an iron band or the like is shrink fitted or overlap wound, for clamping, to the periphery of a plate brick, the plate brick cannot be split in type. That is, in the case of plate bricks in one body structure, cracking is apt to occur, even the positions of generating cracks are irregular thereby to cause an abnormal melt-down, and this causes troubles or shortens the life of the bricks.

(5) In the known methods the cooling effect of the plate bricks was not sufficient. It was all to air cool the interior of the SV equipment so that sufficient cooling was not effected, the clamping effect of said iron band is lost due to high temperature, and the SV equipment in entirety is promoted for deformation.

(6) A lot of labor and working time are required in that the plate bricks are discharged one by one depending on their kind, and new ones are set also one by one to the SV equipment.

(7) Erroneous setting of the plate bricks is likely to occur so that it is difficult to adjust the plate bricks themselves.

To solve the above problems of known systems, a technique for cassettizing the respective plate bricks is disclosed in Japanese Patent Publication No. 59-21701, and a method for surface pressure loading in the case of using a cassettized plate brick assembly is disclosed in Japanese Patent Publication No. 60-15429.

However, even the known techniques described in said publications have the undermentioned problems because a cassette is inserted in parallel with the sliding surfaces.

(1) For joining with the insert nozzle (pouring-out nozzle 5) there is required, causing complication, a mechanism for moving and pressing said cassette in the rectangular direction to the shell of a tundish (TD).

(2) Coupling with a driving mechanism (oil pressure cylinder) for sliding is required, said driving mechanism is mounted in the insertion position of the cassette so that after the cassette insertion it is necessary to separately mount another driving mechanism to the tundish or ladle shell, and coupling working with the cassette is also required. Thus, the known techniques are not practical.

(3) Because of the coupling with the insert nozzle the shape of the cassette must be tapered as shown in FIG. 15 of Publication No. 59-21701. Such shaping makes the space between the ladle or the tundish shell and the cassette 42 wide, the insert nozzle 5 and the cassette 42, including the connection portion therebetween, appear naked, and cracking is apt to occur thereby to cause troubles such as leakage of molten steel.

On the other hand, since tapering is in the insertion direction the positioning (circumferential direction to the nozzle core) of the insert nozzle 5 is difficult, and if the joints are not secured it is likely to cause troubles such as leakage of molten steel.

(4) In case a cassette is inserted in the combination of the plate bricks illustrated in FIG. 1 of said publication, the known technique is not practical in that the bricks are not fixed to the sliding and that the bricks are not connected to the driving mechanism for sliding.

(5) As shown in FIGS. 3 to 5, the surface pressure is loaded with a force for insertion in the horizontal direction, so that the insertion needs to be made with rather a great force. This requires an insertion device therefor, and therefore the known technique is not practical in relation to the driving mechanism for sliding.

DISCLOSURE OF THE INVENTION

The inventors of this invention have made a variety of researches and experiments to remove the above various demerits of the known techniques, and as a result the present invention has been developed. The technical constitution of the invention is as described below.

The invention relates to a plate assembly cartridge for an SV equipment, which is equipped with an assembly mechanism that is mounted with a metallic or ceramic holder at the outer periphery of the side surface of each plate for the SV equipment and that mutually connects said holders, and which is characterized in that the holder for the slide plate is arranged in such a way that the two faces of the holder may be slightly set back from the sliding surface of the slide plate. Said holders are provided with voids or holes for mounting sensors for a cold and/or temperature, the voids for a cold communicate with one another, the surfaces at the sliding sides of said holders are provided with a ceramic coating, said holders have a mechanism for press fixing or meshing them mutually, the plate brick for mounting the SV equipments may be split in a plurality of parts radially from the center of the molten steel flow opening, and the connection face of each of said holders with each plate brick may be inclined.

On the other hand, the invention is concerned with an SV equipment of using a plate brick cartridge for the SV equipment, characterized in that the surface pressuring loading mechanism has a driving mechanism in which two surface pressure loading clamps open and close in the sliding directions, and the housing has an oil pressure or air cylinder for the surface pressure loading. Said surface pressure loading mechanism is provided additionally with a remote control mechanism, even the mechanism for fixing a submerged nozzle is of remote control, and a heat-resistant ceramic plate is involved wholly or partially between the SV equipment and the bottom plate of the ladle or tundish thereby securing a heat-insulating structure.

THE BEST MODE FOR CARRYING OUT THE INVENTION

The invention will be described in detail, by way of embodiments, with reference to the accompanying drawings.

Figure 4:
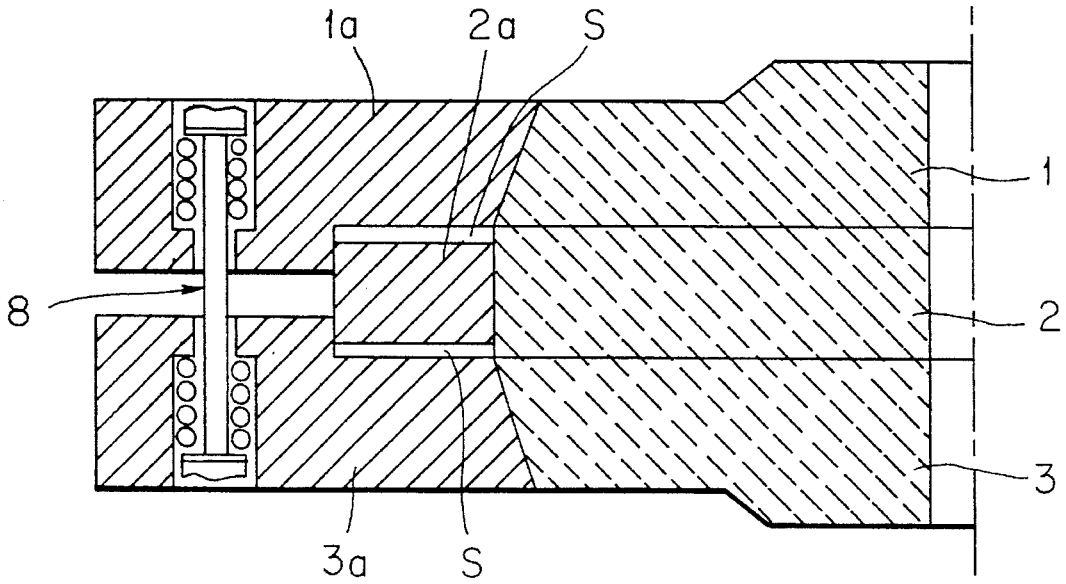
FIG. 4 is a vertical, sectional view showing an example where the holders are provided with a surface pressuring loading mechanism.
Figure 5:
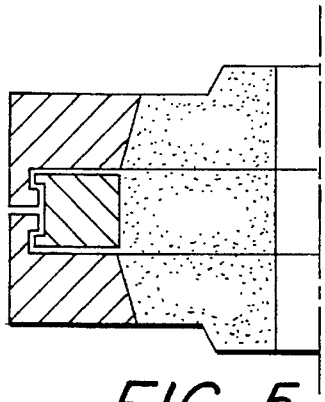
FIG. 5 is a vertical, sectional view showing an example of a meshing mechanism of the holders.
Figure 6:
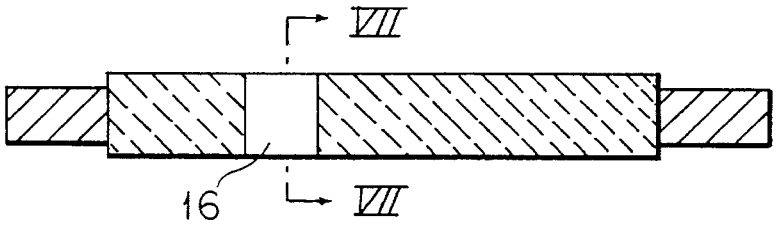
FIG. 6 is a vertical, sectional view showing the connection portion of a plate brick and a holder.

The plate brick cartridge for the SV equipment of the invention is such that for example, as shown in FIG. 4, the outer peripheries at the side surfaces of respective plate bricks 1, 2, 3 are fixed with metallic or ceramic holders 1*a*, 2*a*, 3*a*. Of these holders the holder 2*a* for the slide plate brick is provided at both the surface S, S of its sliding sides with a slight clearance each between the upper surface S and the slide surface of the holder of a bottom plate and between the lower surface S and the slide surface of the holder of a seal plate, and the slide plate brick 2 is arranged being set back from its slide surface. Because of a void formed by the setting back, in the case of loading a surface pressure onto the slide surface between each of the bottom plate 1 and the seal plate 3 and the slide plate brick 2 by means of the action of a surface pressure loading mechanism referred to below, no load is applied between said holders, and surface pressure is loaded only to the slide surface of each plate whereby the sealing property of the plate brick cartridge in the SV equipment is improved.

Figure 10:
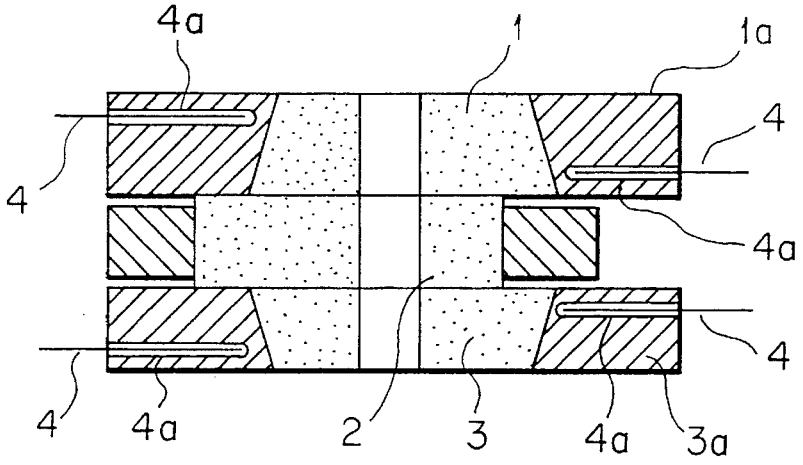
FIG. 10 is a vertical, sectional view showing an example where the holders are mounted with a temperature sensor.
Figure 12:
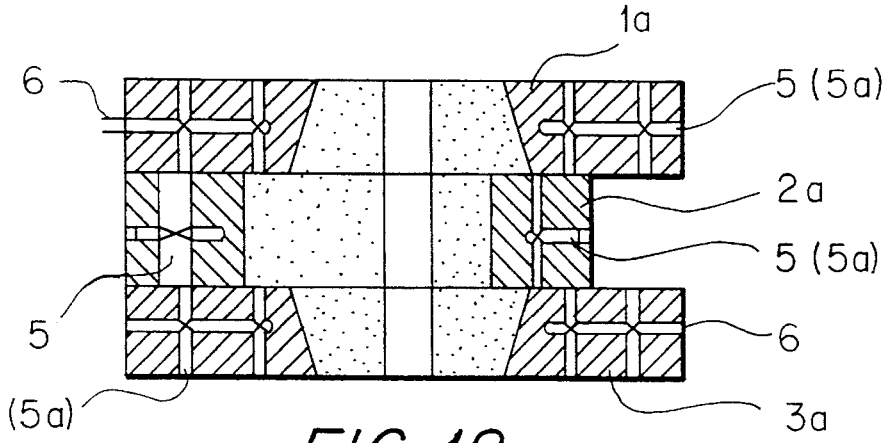
FIG. 12 is a sectional view of an example where the holders are provided with voids or holes for cooling.

As shown in FIG. 10, the holders 1*a* and 3*a* of the bottom and seal plate bricks are provided with slits 4*a* for fixing temperature sensors (thermocouples) 4, and as shown in FIG. 12, the brick assembly is provided with a number of voids 5 and/or holes 5*a* which mutually communicate with the holders 1*a*, 2*a*, 3*a* of the bottom, slide and seal plate bricks 1, 2, 3, an inert gas is introduced as a cold from connection ports 6 to allow said cartridge to be cooled, and the insert gas is discharged into the clearances between said holders in the circumferences of the plate bricks and into a housing 15 (FIG. 3) whereby it is possible to retain the interior of said housing in an inert atmosphere thereby planning to prevent the molten steel from oxidation. Additionally, the temperature sensors may either be fitted into grooves being provided or affixed.

Figure 11:
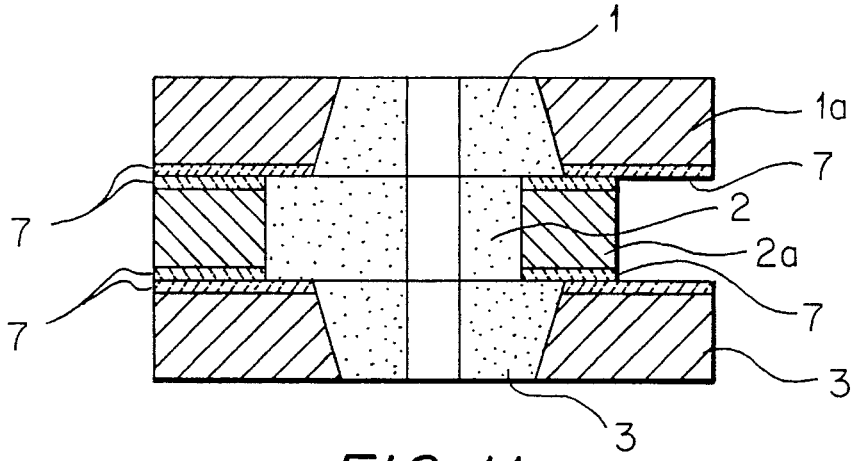
FIG. 11 is a vertical, sectional view of the holders, the slide surfaces of which have a ceramic coating.

By applying a ceramic coating 7 (FIG. 11) to the surfaces at the slide sides of said holders, leakage of molten steel from the SV equipment is prevented whereby it is capable of improving the durability of the high grade refractory used for the plate bricks.

Figure 13:
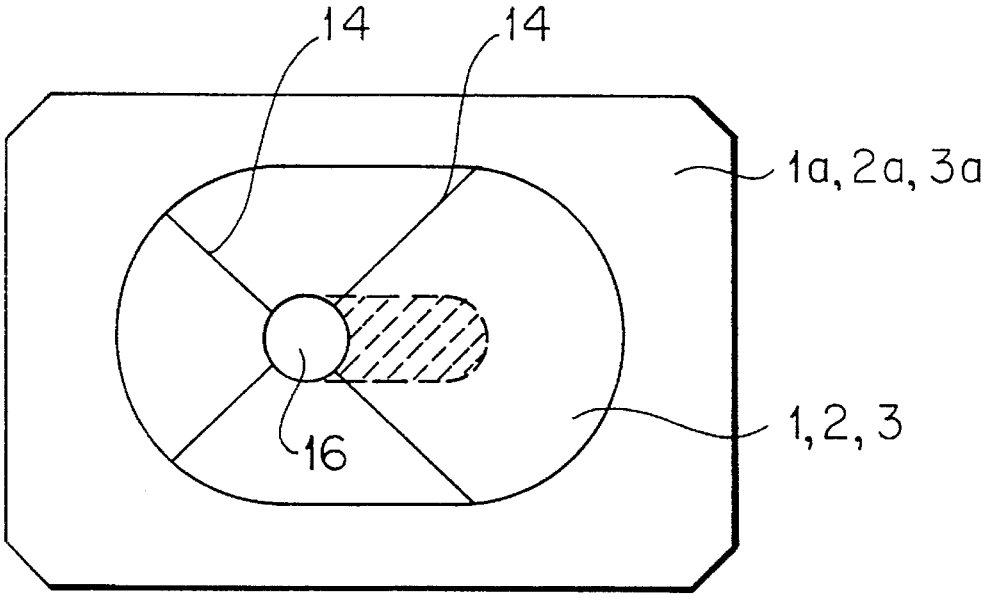
FIG. 13 is a plan view showing an example where a plate brick is split into a plurality of parts.

As shown in FIG. 13, a plate brick is previously split into a plurality (two to four) parts radially from the center of a molten steel flow hole 16, and it is used being mounted to said holder. Thus, the split faces 14 absorb the deformation generated being accompanied by the expansion and contraction caused by the heat cooling when used. This lessens the generation of cracks, enables the cartridge to be used stably, and prolongs the life of the plate bricks.

Said holders are provided with a press fixing mechanism 8 as shown (in the sectional half) of FIG. 4, and by press fixing in advance the respective plate bricks together by means of only the cartridge itself, it is possible to set a surface pressure adjustment between the plate bricks previously and accurately. Moreover, the surface pressure loading mechanism provided in the housing can be simplified, and the housing of the plate brick cartridge can be easily and simply mounted.

Figure 7:
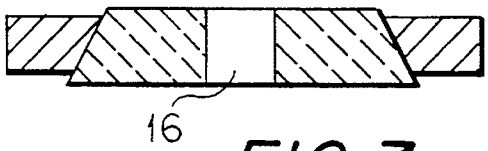
FIG. 7 is a sectional view taken along the line VII—VII of FIG. 6.
Figure 8:
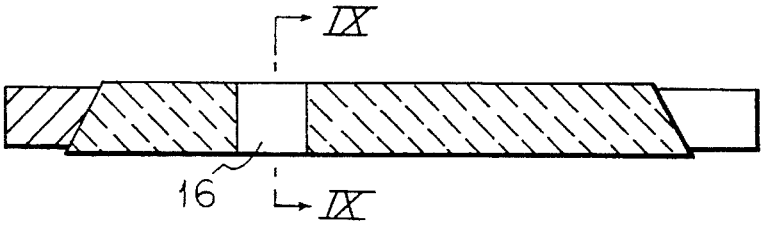
FIG. 8 is a vertical, sectional view showing another example of the connection portion of a plate brick and a holder.
Figure 9:
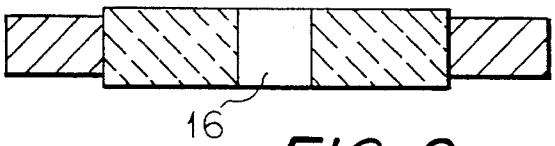
FIG. 9 is a sectional view taken along the line IX—IX of FIG. 8.

In assembling said holders 1*a*, 2*a*, 3*a* with said plate bricks 1, 2, 3, the connection faces are made inclined at predetermined angles as shown in FIGS. 5 to 8 whereby it is possible that the surface pressure loads of the respective plate bricks are further effective. As an embodiment, in case molten steel passes through the nozzle thereby expanding the plate bricks and slides in the connection faces of said plate bricks with the holders, an angle of inclination is taken in the direction where the surface pressure increases. FIG. 7 is a sectional view taken along the line VII—VII of FIG. 6, while FIG. 9 is a sectional view taken along the line IX—IX of FIG. 8. Additionally, said angle of inclination is made outwardly (as shown in FIG. 4) toward the surface pressure loading, and it will suffice both to use or not to use a cushion material at the connection faces.

Figure 1:
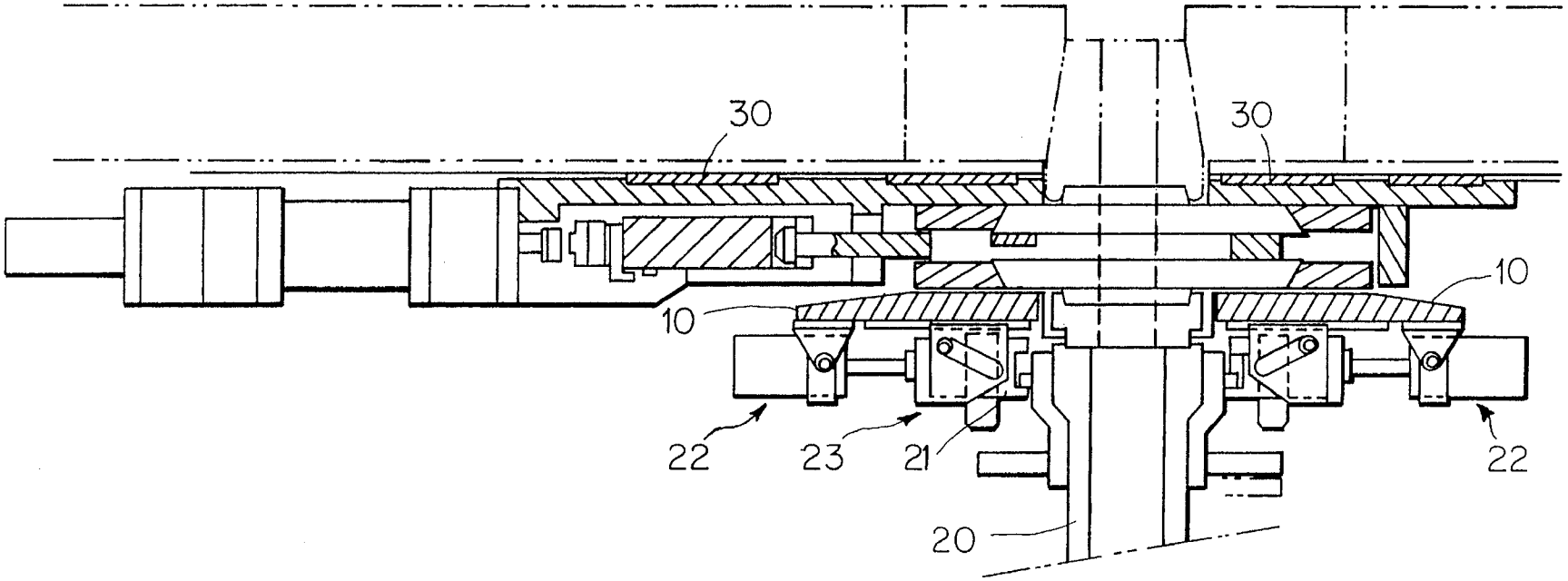
FIG. 1 is a vertical, sectional view showing the major portion of the present invention.
Figure 2:
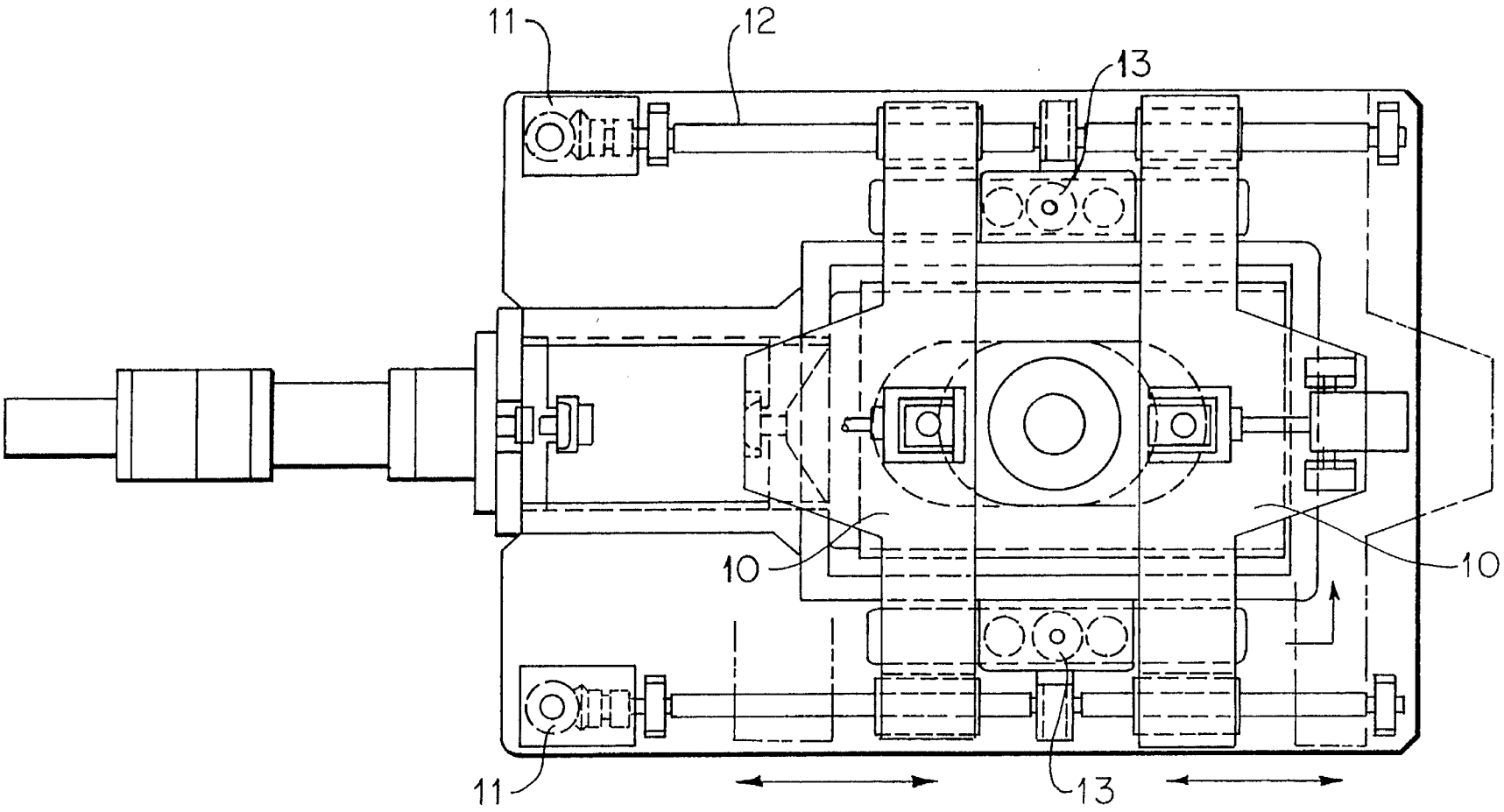
FIG. 2 is a lower view of FIG. 1.
Figure 3:
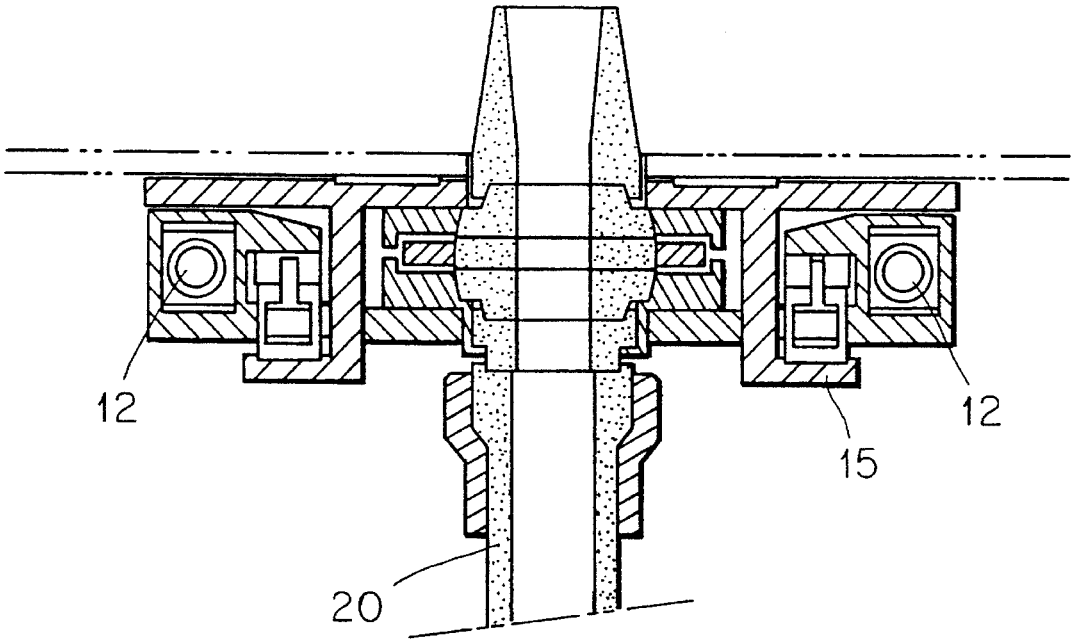
FIG. 3 is a vertical, sectional view showing the cartridge and surface pressure loading mechanism of the invention.

As shown in FIGS. 1 to 3, the surface pressure loading mechanism of the invention is provided with two clamps 10, 10 for surface pressure loading, and said clamps are opened and closed in the directions of the arrows in FIG. 2 by drive mechanisms 11, 11. Each of the drive mechanisms consists of a drive source such as motor and a screw shaft 12 connected to said drive source 11, and they are fixed to the housing. Said clamps 10, 10 are couplied with said screw shafts 12, 12 thereby to be opened and closed by the turning of the drive source 11.

On the other hand, the housing is provided with a plurality of oil or air pressure cylinders 13, and surface pressure is loaded to the plate brick cartridge by the action of these cylinders.

Said surface pressure mechanism can make an accurate surface pressure loading by means of known remote control means (not shown) without causing any danger and necessitating a skill. In the case of known surface pressure loading system relying on coil spring or the like, the coil spring gradually wears while in use so as to decrease the load, so that the coil spring needs to be periodically inspected for replacement. The irregularity in the surface pressure loading force is too great when a new spring has been set and when an old spring before replacement was in use, and the surface pressure loading force sometimes decreases due to erroneous inspection thereby to lead to an accident of molten steel leakage.

In the case of the surface pressure loading mechanism by oil or air pressure cylinder according to the invention, it is possible to usually load a fixed surface pressure by administering the pressure.

The SV equipment of the invention is equipped with a mechanism with a submerged nozzle, in which a submerged nozzle 20 can be set by remote control means. The mechanism of fixing the submerged nozzle is constructed as described below.

The mechanism is constituted by a hook 21 for supporting and pressing the submerged nozzle 20, a driving portion 22 for lifting said hook, and a mechanism 23 for converting the action in the horizontal direction to one in the vertical direction. Said driving portion 22 is an oil or air pressure cylinder or the like, and the driving force acting in the horizontal direction is switched to an action in the vertical direction by said conversion mechanism 23, when the submerged nozzle is moved vertically at said hook thereby to be pressed upwardly or lowered.

In fixing the SV equipment of the invention to a ladle or tundish, a heat-insulating ceramic plate 30 is involved wholly or partially therebetween so that it is capable of largely decreasing the heat transmission to the SV equipment, above all to the housing, to prevent the temperature of the SV equipment from rising. One example is illustrated in FIG. 1, wherein the heat-insulating ceramic plate 30 is involved partially. Said ceramic plate 30 is fitted, for example, by fixing it by bolts or providing recesses in the housing. Any fixing means will suffice if it exhibits a heat-insulating effect.

Though the invention has been described, by way of embodiments, with reference to the accompanying drawings, other embodiments of the invention are described below.

(1) A plate brick cartridge for an SV equipment is incorporated into the housing of the SV equipment in the rectangular direction or within an angle of ±60° relative to the bottom plate of a ladle or tundish. Such construction removes the abovementioned demerits of known systems, presents a practically useful machine and makes an automation.

(2) The plate brick cartridge for an SV device can be such one in which a plurality of plate bricks are incorporated with an insert nozzle and/or lower nozzle. Owing to such a construction it is possible to decrease the frequency of insertion of the refractory members into the molten steel vessel and the frequency of setting working. On the other hand, since the assembly is made up under off-line system it is possible to sufficiently administer the respective connecting joints so as to be able to avoid troubles caused by erroneous setting on the spot.

(3) Like conventionally, it is possible to use the plate bricks fitted under tension by shrink fitting or the like of an iron band or the like by incorporating them into said holders.

(4) It is also capable of using the plate bricks in which carbon fiber or steel wire is fitted under tension to the outer periphery of them, by incorporating them into said holders.

The effects of the present invention will be stated below.

(1) When the surface pressure is loaded a slight clearance is left between said holders so that the surface pressure is loaded only to the sliding surfaces of the respective plate bricks.

(2) Provision of temperature sensors according to the invention near the plate bricks of said holders will sense troubles such as molten steel leakage can be prevented in advance.

(3) Provision of holes or voids in the holders will improve the cooling effect of the holders, and therefore deformation of said holders can be lessened whereby the life of the holders can be prolonged.

Further, by improving the cooling effect it is possible to make the thermal expansion of the holders smaller than that of the plate bricks. This results in restraining said plate bricks from their entire periphery by said holders, so that the durability of the plate bricks can be improved thereby also improving the control precision.

Practically, cracking is prevented from enlarging, and flow control is carried out by sliding the slide plate, but by the sliding force it is possible to prevent said plate bricks from moving (playing) within the holders and to improve the control precision of the molten steel flow rate.

(4) It is possible to feed a cold from the outside into the voids and holes in all the holders which are constituted by providing connection ports 6 at a single place.

(5) An inert gas may be fed from the outside to cool the holders, and slight clearances between the respective holders are filled with the inert gas whereby the molten steel can be prevented from oxidation.

(6) Even when molten steel leaks out of the slide surfaces of the plate bricks a ceramic coating is capable of preventing leakage to the outside by melting the holders. In short, the coated ceramic article prevents the metallic holders from melting-down to allow the leaked molten steel to be coagulated.

Thus, the plate bricks can be used to their full life while feeling at rest. Further, the plate bricks can be prepared as small as possible, as necessary.

Usually, in plate bricks a plurality of cracks take place toward the opening of the molten steel flow, being caused by the thermal stress by heating and cooling accompanied by the passage of the molten steel. If large cracks take place at the centers of the plate bricks it sometimes causes an abnormal melting-down thereby bringing about a leakage accident.

To cope with this disadvantage above, if a plate brick is previously split into some parts said thermal stress can be absorbed whereby it can be prevented that large cracks generate in the portions which are brought into contact with molten steel in flow control.

(7) Because the holders are provided with a mutual press fixing mechanism it is possible to adjust the surface pressure loading force under off-line system to provide a sufficient surface pressure administration; since the surface pressure can be loaded in the cartridge itself and a surface pressure loading mechanism need not to be provided in the SV equipment it is possible to construct the SV equipment; in such case the SV equipment may have a simple mechanism only for fixing the cartridge.

Metal fittings (such as bolts and nuts) for assembling the respective holders need not to be provided; the assembling working is accelerated whereby automation can be easily made; erroneous setting is avoided; if, for example, a holder is clamped with four sets of bolts and nuts, one set thereof may sometimes be forgotten for clamping.

(8) In making a plate brick and a holder in one body, in the case of using mortar, gluing material or the like therebetween it becomes easier to press fill it.

Even if the plate bricks expanded and a slide took place between the bricks and the holders the surface pressure is to increase so that the cartridge can be used safe.

(9) Since the clamps for surface pressure loading are opened and closed it is possible to occupy a wide space for the insertion and discharging of the cartridge.

Provision of an oil or air pressure cylinder for surface pressure loading in the housing will accelerate cooling thereby to lessen the heat load.

On the other hand, since it is possible to provide a pipe line without hoses for feeding oil and compressed air, consumable articles decrease while increasing safety (because the housing is fixed to the ladle or tundish).

(10) Because of the possible remote control of the surface pressure loading mechanism the series of operations from insertion of cartridge to surface pressure loading working can be automated.

Even while casting it is possible to adjust and administer the surface pressure loading force. (This was impossible according to known techniques).

(11) A submerged nozzle can be automatically mounted or discharged.

Being provided in the clamps for surface pressure loading the working for inserting and setting the cartridge is not hindered.

(12) Since the slide gate valve is brought into contact with a ladle or tundish through a ceramic plate it is capable of extensively decreasing the temperature rise of the housing, which is caused by thermal transmission. This leads to a decrease of deformation and to a prolonged life of the surface pressure loading mechanism incorporated in the housing whereby the slide gate valve can be used safely.

INDUSTRIAL FIELD OF THE INVENTION

The present invention is used for a slide gate valve, and particularly a plate brick cartridge for a slide gate valve, and for a slide gate valve mounted with said cartridge.

We claim:

1. A plate brick assembly cartridge for a slide gate valve comprising:

a bottom plate brick, a sliding plate brick and a seal plate brick, each of said plate bricks having upper and lower planar surfaces, having an aperture for the flow of material therethrough, and having a metallic or ceramic holder mounted peripherally thereof, said sliding plate brick being slidably interposed between said bottom plate brick and said seal plate brick with the upper planar surface of said sliding plate brick being in sliding contact with the lower surface of said bottom plate brick and with the lower surface of said sliding plate brick being in sliding contact with the upper surface of said seal plate brick, the holder of said sliding plate brick having upper and lower surfaces that are set back relative to the upper and lower surfaces of said sliding plate brick whereby, on sliding movement of said sliding plate brick between said bottom plate brick and said seal plate brick, the upper and lower surfaces of said sliding plate brick holder will not contact said lower surface of said bottom plate brick or the upper surface of said seal plate brick;

means carried by said holders of said bottom and seal plate bricks for positioning said bottom and seal plate bricks in superposed adjacency with said sliding plate brick slidably interposed therebetween and with the apertures of said bottom and seal plate bricks in registry whereby said sliding plate brick is slidable therebetween such that its aperture can be moved into and out of registry with the apertures in said bottom and seal plate bricks;

means carried by said holders of said bottom and seal plate bricks for urging the lower surface of said bottom plate brick against the upper sliding surface of said sliding plate brick and for urging the upper surface of said seal plate brick against the lower sliding surface of said sliding plate brick; and temperature monitoring means located within at least one of said holders for monitoring the temperature thereof.

2. A plate brick assembly cartridge according to claim 1 wherein said holders are provided with coolant ducts.

3. A plate brick assembly cartridge according to claim 1 wherein the upper and lower surfaces of said sliding plate brick, the lower surface of said bottom plate brick, and the upper surface of said seal plate brick each have a ceramic coating.

4. A plate brick assembly cartridge according to claim 1 wherein the holder of each plate brick has an inner side face in engagement with the outer peripheral side face of a respective plate brick, the side faces of at least one plate brick and holder being inclined with respect to the vertical.

5. In a slide gate valve having a plate brick assembly cartridge, the improvement wherein said cartridge comprises:

a bottom plate brick, a sliding plate brick and a seal plate brick, each of said plate bricks having upper and lower planar surfaces, having an aperture for the flow of material therethrough, and having a metallic or ceramic holder mounted peripherally thereof, said sliding plate brick being slidably interposed between said bottom plate brick and said seal plate brick with the upper planar surface of said sliding plate brick being in sliding contact with the lower surface of said bottom plate brick and with the lower surface of said sliding plate brick being in sliding contact with the upper surface of said seal plate brick, the holder of said sliding plate brick having upper and lower surfaces that are set back relative to the upper and lower surfaces of said sliding plate brick whereby, on sliding movement of said sliding plate brick between said bottom plate brick and said seal plate brick, the upper and lower surfaces of said sliding plate brick holder will not contact said lower surface of said bottom plate brick or the upper surface of said seal plate brick;

means carried by said holders of said bottom and seal plate bricks for positioning said bottom and seal plate bricks in superposed adjacency with said sliding plate brick slidably interposed therebetween and with the apertures of said bottom and seal plate bricks in registry whereby said sliding plate brick is slidable therebetween such that its aperture can be moved into and out of registry with the apertures in said bottom and seal plate brick;

means carried by said holders of said bottom and seal plate bricks for urging the lower surface of said bottom plate brick against the upper sliding surface of said sliding plate brick and for urging the upper surface of said seal plate brick against the lower sliding surface of said plate brick; and temperature monitoring means located within at least one of said holders for monitoring the temperature thereof.

6. An improved gate valve according to claim 5 further comprising a ceramic insulating plate for interposing between the gate valve and a vessel to which the gate valve may be fitted.

* * * * *